US009011032B2

(12) United States Patent
Schlatter

(10) Patent No.: US 9,011,032 B2
(45) Date of Patent: Apr. 21, 2015

(54) MINIATURE BRUSH FOR ORAL HYGIENE

(76) Inventor: Gary Schlatter, Englewood, CO (US)

( * ) Notice: Subject to any disclaimer, the term of this patent is extended or adjusted under 35 U.S.C. 154(b) by 246 days.

(21) Appl. No.: 13/584,031

(22) Filed: Aug. 13, 2012

(65) Prior Publication Data

US 2013/0036566 A1 Feb. 14, 2013

Related U.S. Application Data

(60) Provisional application No. 61/522,885, filed on Aug. 12, 2011.

(51) Int. Cl.

| | |
|---|---|
| ***B43K 5/14*** | (2006.01) |
| ***A46B 9/04*** | (2006.01) |
| ***A46B 5/02*** | (2006.01) |
| ***A46B 11/00*** | (2006.01) |
| ***A46B 15/00*** | (2006.01) |

(52) U.S. Cl.

CPC ... *A46B 9/04* (2013.01); *A46B 5/02* (2013.01); *A46B 11/0003* (2013.01); *A46B 15/0069* (2013.01); *A46B 15/0081* (2013.01); *A46B 15/0087* (2013.01); *A46B 2200/1066* (2013.01)

(58) Field of Classification Search

USPC ..... 401/132, 268; 15/167.1

See application file for complete search history.

(56) References Cited

U.S. PATENT DOCUMENTS

| | | | |
|---|---|---|---|
| 2,262,982 | A | 11/1941 | Wolcott |
| 2,649,959 | A | 8/1953 | Hallahan |
| 2,778,045 | A | 1/1957 | Bly et al. |
| 3,691,585 | A | 9/1972 | Flom |
| 3,917,420 | A | 11/1975 | Watson |
| 4,911,187 | A | 3/1990 | Castillo |
| 5,242,235 | A | 9/1993 | Li |
| 6,004,059 | A | 12/1999 | Zaccaria |
| 7,182,542 | B2 | 2/2007 | Hohlbein |
| 7,331,731 | B2 | 2/2008 | Hohlbein et al. |
| 7,478,959 | B2 | 1/2009 | Hohlbein |
| 7,594,293 | B2 | 9/2009 | Xi et al. |
| D614,869 | S | 5/2010 | Wong |
| 7,725,980 | B2 | 6/2010 | Moskovich |
| 2002/0175101 | A1 | 11/2002 | Albert |
| 2006/0010628 | A1 | 1/2006 | Moskovich |
| 2008/0120798 | A1 | 5/2008 | Sorrentino et al. |
| 2008/0313835 | A1 | 12/2008 | Russell et al. |
| 2009/0044356 | A1 | 2/2009 | Noble et al. |
| 2009/0178219 | A1 | 7/2009 | Hohlbein |
| 2009/0320224 | A1 | 12/2009 | Hohlbein et al. |
| 2009/0320226 | A1 * | 12/2009 | Robinson et al. ..... 401/141 |

* cited by examiner

*Primary Examiner* — David Walczak
*Assistant Examiner* — Bradley Oliver
(74) *Attorney, Agent, or Firm* — Welsh Flaxman & Gitler LLC

(57) ABSTRACT

A miniature brush for dental hygiene having an elongated body having a first end in the form of a brush head and a second end, the elongated body also includes an upper elongated body surface and a substantially opposite facing bottom elongated body surface. The brush head including an upper brush head surface and a substantially opposite facing bottom brush head surface including a plurality of bristles extending from the bottom brush head surface and an anhydrous gel coupled to and extending from the bottom brush head surface.

10 Claims, 3 Drawing Sheets

MINIATURE BRUSH FOR ORAL HYGIENE

CROSS REFERENCE TO RELATED APPLICATION

This application claims the benefit of U.S. Provisional Patent Application Ser. No. 61/522,885, entitled "MINIATURE BRUSH FOR ORAL HYGIENE", filed Aug. 12, 2011.

BACKGROUND OF THE INVENTION

1. Field of the Invention

The present invention relates to a miniature brush for oral hygiene.

2. Description of the Related Art

Oral hygiene is important. Whether you are heading out on a date, meeting with a client or giving your wife a kiss goodnight, it is important that you not have food in your teeth or bad breath.

Unfortunately, a toothbrush and mouthwash are not always readily available. In fact, as our society becomes more and more mobile, we are more often than not away from such conveniences.

As such, the present invention provides an oral hygiene tool that is convenient to use, portable and readily disposable.

SUMMARY OF THE INVENTION

It is, therefore, an object of the present invention to provide a miniature brush for dental hygiene including an elongated body having a first end in the form of a brush head and a second end. The elongated body also includes an upper elongated body surface and an opposite facing, bottom elongated body surface. The brush head includes an upper brush head surface and an opposite facing, bottom brush head surface including a plurality of bristles extending from the bottom brush head surface. Each of the bristles includes a first end secured to the bottom brush head surface of the brush head and second end freely extending away from the bottom brush head surface of the brush head. The bottom brush head surface of the brush head includes a first planar surface from which bristles extend and a second planar surface, wherein a plane in which the second planar surface lies is closer to the second ends of the bristles than a plane in which the first planar surface lies. An anhydrous gel is coupled to and extends from the second planar surface along the bottom brush head surface.

It is also an object of the present invention to provide a miniature brush wherein each of the bristles includes a first end secured to the bottom brush head surface of the brush head and a second end freely extending away from the bottom brush head surface of the brush head, and the bottom brush head surface of the brush head includes a first planar surface from which bristles extend and a second planar surface to which the gel is coupled and from which the gel extends, wherein a plane in which the second planar surface lies is closer to the second ends of the bristles than a plane in which the first planar surface lies.

It is another object of the present invention to provide a miniature brush wherein the gel is anhydrous of a viscosity that it adheres to the second planar surface.

It is a further object of the present invention to provide a miniature brush wherein a logo is formed along the elongated body.

It is also an object of the present invention to provide a miniature brush wherein the logo is formed along the bottom elongated body surface of the elongated body.

It is another object of the present invention to provide a miniature brush wherein the logo is textured to enhance gripping.

It is a further object of the present invention to provide a miniature brush wherein the second end of the elongated body is pointed and may function as a toothpick.

It is also an object of the present invention to provide a miniature brush wherein the upper brush head surface includes a plurality of outwardly extending ridges used for tongue cleaning.

It is another object of the present invention to provide a miniature brush wherein each of the plurality of ridges is arcuate.

It is a further object of the present invention to provide a miniature brush wherein the gel is a mixture of Glycerin, PEG-8, Carbomer, Flavor, Menthol, Sorbitol, Sucralose, Methylparaben, Gelatin Crosspolymer and coloring.

It is also an object of the present invention to provide a miniature brush wherein the gel is dispersed in two separate areas on the brush head.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
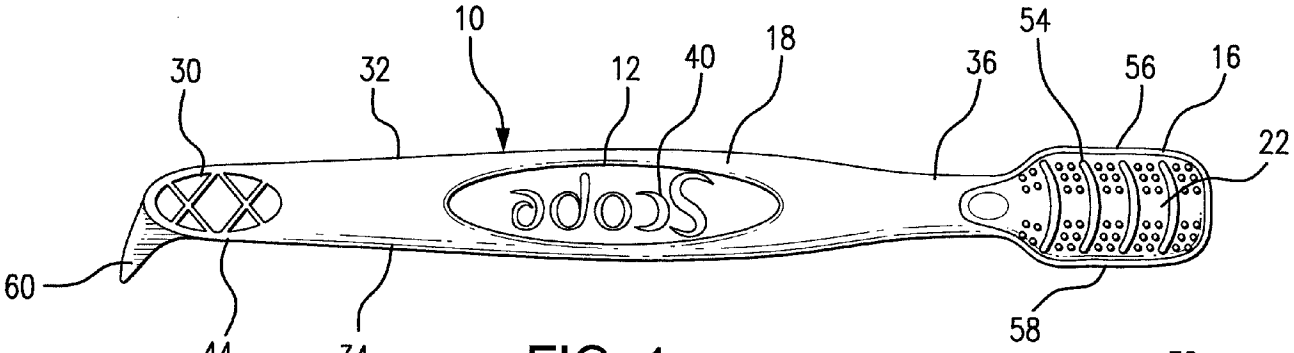
FIG. 1 is a top plan view of a miniature brush in accordance with the present invention.
Figure 2:
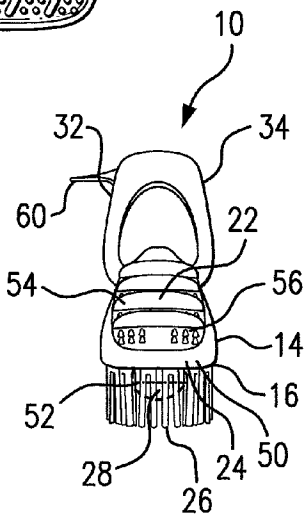
FIG. 2 is a top plan view of the miniature brush.
Figure 3:
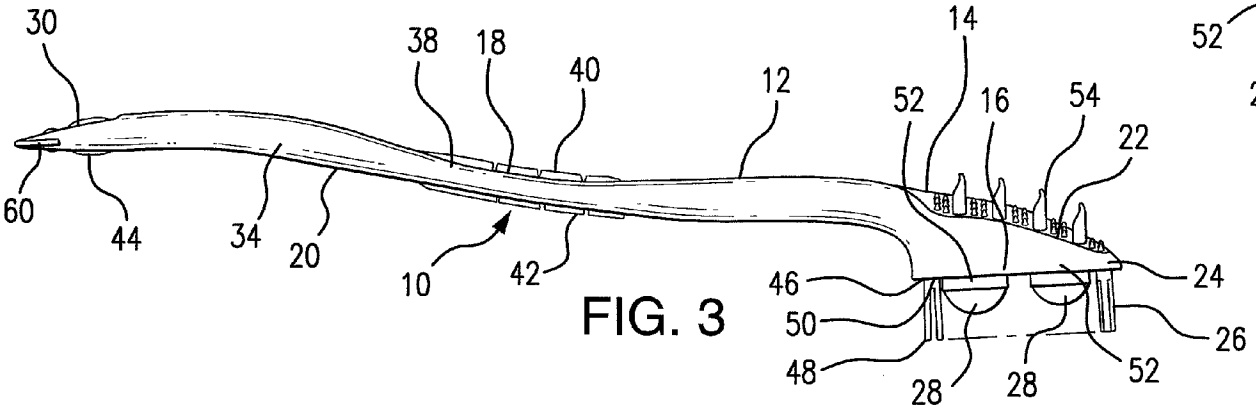
FIG. 3 is a side plan view of the miniature brush.

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

In accordance with the present invention, and with reference to FIGS. 1 to 9, a miniature brush 10 for dental hygiene is disclosed. The miniature brush 10 includes an elongated body 12 having a first (or distal) end 14 in the form of a brush head 16 and a second (or proximal) end 30. The elongated body 12 also includes an upper elongated body surface 18 and an opposite facing, bottom elongated body surface 20. The brush head 16 includes an upper brush head surface 22 formed along the upper elongated body surface 18 and an opposite facing, bottom brush head surface 24 formed along the bottom elongated body surface 20. The bottom brush head surface 24 includes a plurality of bristles 26 extending from the bottom brush head surface 24. Gel 28 is coupled to and extends from a raised platform 52 extending above the first (or primary) planar surface 50 of the bottom brush head surface 24.

The elongated body 12 of the miniature brush 10 is ergonomically shaped to facilitate convenient gripping by a user of the miniature brush 10. As such, and in accordance with a preferred embodiment, the elongated body 12 includes various sections positioned between the first end 14 thereof and the second end 30 thereof which facilitate gripping by a user of the present invention.

In discussing the structure of the elongated body 12, as well as the other components of the present miniature brush 10, various terms will be used that should be appreciated by those skilled in the art. For example, "thickness" (and variations thereon) will be used to describe the distance between the upper elongated body surface 18 and the bottom elongated body surface 20. "Width" (and variation thereon) is used to describe the distance from a left lateral side wall 32 of the elongated body 12 to the right lateral side wall 34 (when viewed from above the miniature brush 10). It should also be appreciated terms such as left, right, upper, bottom, etc. are relative terms and are used herein in appreciation of the miniature brush orientation shown in the drawings accompanying the present application.

Directly adjacent the brush head 16, that is, proximal the brush head 16 and between the central section 38 and the brush head 16, the elongated body 12 is provided with an arcuate thickened section 36 that functions as a buttress providing a user with a tactile indication he or she is close to the brush head 16. The central section 38 of the elongated body 12 is provided with a texture surface 40, 42, for example, in the form of a logo, formed along both the upper elongated body surface 18 and the bottom elongated body surface 20. The central section 38 is also formed with a slightly concave profile along the upper elongated body surface 18 and an opposed slightly convex profile along the bottom elongated body surface 20. Adjacent the second end 30 of the elongated body 12 a rear section 44 is provided. The rear section 44 includes a slightly concave profile along the bottom elongated body surface 20 and an opposed slightly convex profile along the upper elongated body surface 18. The elongated body 12 is formed with a slightly bulging profile along the center thereof, that is, the central section 38 is wider than either the arcuate thickened section 36 of the elongated body 12 or the rear section 44 of the elongated body 12. These features are provided to enhance the ergonomics of the miniature brush 10 and facilitate ease of handling the miniature brush 10 considering the small size of the miniature brush 10.

As briefly discussed above, a brush head 16 is formed at the first end 14 of the elongated body 12. The brush head 16 includes the bottom brush head surface 24 from which a plurality of bristles 26 extend. Each of the bristles 26 includes a first end 46 secured to the bottom brush head surface 24 of the brush head 16 and second end 48 freely extending away from the bottom brush head surface 24 of the brush head 16.

The bottom brush head surface 24 of the brush head 16 includes a first planar surface 50 from which the plurality of bristles 26 extend and a pair of elevated second planar surfaces, that is, the raised platforms 52 previously discussed to which the gel is coupled and from which the gel 28 extends, wherein a plane in which the second (or elevated) planar surfaces 52 lies is closer to the second ends 48 of the bristles 26 than a plane in which the first planar surface 50 lies. That is, the gel 28 is elevated from the first planar surface 50 of the bottom brush head surface 24. In accordance with a preferred embodiment, the elevated second planar surfaces 52 are each provided with gel 28 positioned thereon. In particular, the miniature brush 10 disclosed herein includes gel composed of first and second gel members 28 respectively coupled to and extending from the pair of second planar surfaces 52 provided along the bottom brush head surface 24, wherein a plane in which the pair of second planar surfaces 52 and ultimately the first and second gel members, lies closer to the second ends of the bristles 26 than a plane in which the first planar surface 50 lies. However, it is appreciated additional elevated planar surfaces may be provided with gel.

Figures 4, 5, 6, 7:
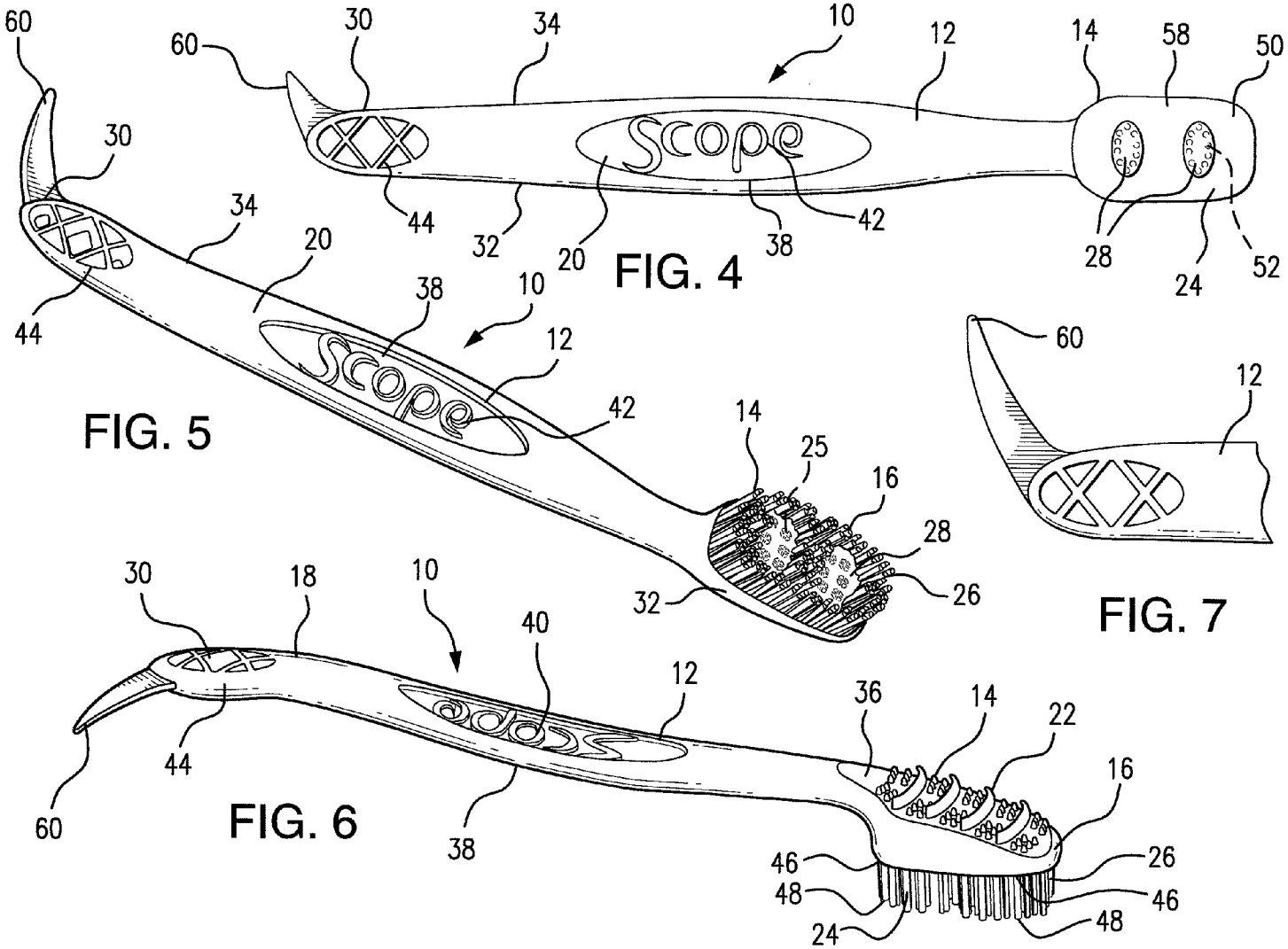
FIG. 4 is bottom plan view of the miniature brush with the bristles not shown.
FIG. 5 is bottom perspective view of the miniature brush.
FIG. 6 is a top perspective view of the miniature brush.
FIG. 7 is a detailed view of the second end of the miniature brush.

In accordance with a preferred embodiment, the gel 28 is of an adhesive nature and directly adheres to the elevated second planar surfaces 52. The elevated second planar surfaces 52 may include bristles 25, as shown in FIG. 5, to further enhance the brushing and to hold the gel thereupon.

Figure 8:
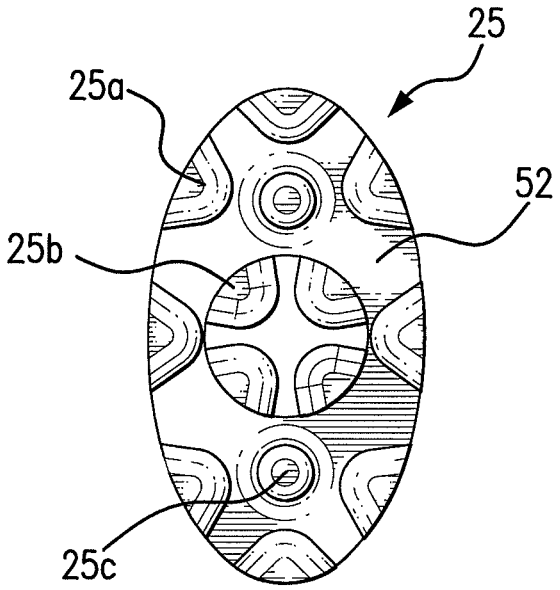
FIGS. 8 and 9 are respectively a top view and a side perspective view of the elevated second planar surface, that is, raised platform, showing a preferred bristle arrangement.
Figure 9:
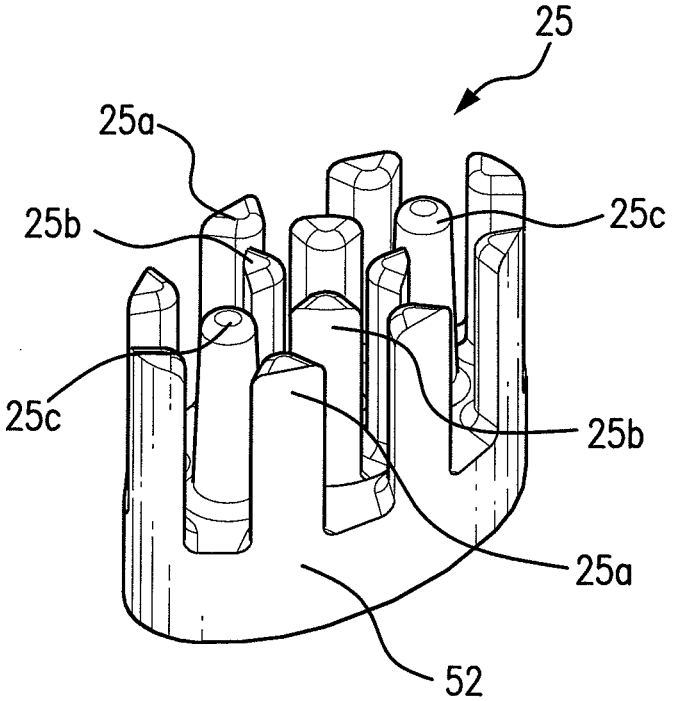

A detailed view of one of the elevated second planar surfaces 52 with a preferred bristle arrangement is disclosed in FIGS. 8 and 9. It is appreciated the elevated second planar surfaces are identical. In particular, the bristles 25 extending from the elevated second planar surface 52 are shorter than the bristles 26 extending from the bottom brush head surface 24. The arrangement is particularly adapted for engaging the gel members 28 and retaining it in position on top of the elevated second planar surfaces 52. As such, a plurality of edge bristles 25*a* are positioned about the circumference of the elevated second planar surface 52, while a plurality of central bristles 25*b* are positioned in a circular orientation at the center of the elevated second planar surface 52. Since the elevated second planar surface 52 is oval in shape when viewed from above, a space exits between the edge bristles 25*a* and the central bristles 25*b* along the long axis of the oval. Intermediate bristles 25*c* are positioned in these spaces.

In accordance with a preferred embodiment, the gel 28 is composed of a mixture of Glycerin, PEG-8, Carbomer, micro-encapsulated Flavor, Menthol, Sorbitol, Sucralose, Methylparaben, Gelatin Crosspolymer and coloring. The gel is anhydrous thus providing extended shelf life of the product since there is no water to evaporate.

The upper brush head surface 22 includes a plurality of outwardly extending ridges 54 used for tongue cleaning. These ridges 54 extend laterally from the left side wall 56 of the brush head 16 to the right side wall 58 of the brush head 16, defining a transverse ridge that may be used for tongue cleaning. The ridges 54 are further enhanced by forming them with a slight arcuate shape as the respective ridges 54 extend from the left side wall 56 to the right side wall 58. The ridges 54, just like the bristles 26, are composed of linear low density polyethylene (LLDPE).

As discussed above, the elongated body 12 includes a second end 30 and the second end 30 is pointed to function as a toothpick. In accordance with a preferred embodiment, the pointed tip 60 of the second end 30 is directed at an oblique angle relative to the longitudinal axis of the elongated body 12.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A miniature brush for dental hygiene, comprising:

an elongated body having a first end in the form of a brush head and a second end, the elongated body also includes an upper elongated body surface and an opposite facing, bottom elongated body surface;

the brush head including an upper brush head surface and an opposite facing, bottom brush head surface including a plurality of bristles extending from the bottom brush head surface, each of the bristles includes a first end secured to the bottom brush head surface of the brush head and second end freely extending away from the bottom brush head surface of the brush head, and the bottom brush head surface of the brush head includes a first planar surface from which bristles extend and a second planar surface, wherein a plane in which the second planar surface lies is closer to the second ends of the bristles than a plane in which the first planar surface lies; and an anhydrous gel mounted on and extending from the second planar surface along the bottom brush head surface.

2. The miniature brush according to claim 1, wherein the gel includes micro-encapsulated flavor.

3. The miniature brush according to claim 1, wherein a logo is formed along the elongated body.

4. The miniature brush according to claim 3, wherein the logo is formed along the bottom elongated body surface.

5. The miniature brush according to claim 3, wherein the logo is textured to enhance gripping.

6. The miniature brush according to claim 1, wherein the second end of the elongated body is pointed and may function as a toothpick.

7. The miniature brush according to claim 1, wherein the upper brush head surface includes a plurality of outwardly extending ridges used for tongue cleaning.

8. The miniature brush according to claim 7, wherein each of the plurality of ridges is arcuate.

9. The miniature brush according to claim 1, wherein the gel adheres to the second planar surface and bristles.

10. The miniature brush according to claim 1, wherein the gel is in the form of a first gel area and a second gel area.

* * * * *